United States Patent [19]

Dompas et al.

[11] 3,942,582

[45] Mar. 9, 1976

[54] MANUFACTURE OF COPPER WIRE ROD

[75] Inventors: John M. Dompas, Olen; Jean L. J. E. Ghyselen, Embourg; Rene E. J. Mortier, Olen, all of Belgium

[73] Assignee: Metallurgie Hoboken-Overpelt, Brussels, Belgium

[22] Filed: Apr. 16, 1974

[21] Appl. No.: 461,325

[30] Foreign Application Priority Data

Apr. 27, 1973 Belgium ..... 130474

[52] U.S. Cl. ..... 164/76; 164/87; 164/270; 164/278; 164/282

[51] Int. Cl.[2] ..... B22D 11/06; B22D 11/12

[58] Field of Search ..... 164/76, 87, 270, 278, 282

[56] References Cited

UNITED STATES PATENTS

| | | | |
|---|---|---|---|
| 2,904,860 | 9/1959 | Hazelett | 164/87 |
| 3,324,931 | 6/1967 | Burgeroth et al. | 164/282 X |
| 3,329,199 | 7/1967 | Easton | 164/282 X |

*Primary Examiner*—Ronald J. Shore
*Attorney, Agent, or Firm*—Fred Philpitt

[57] ABSTRACT

A process for the manufacture of copper wire rod, in which liquid copper is cast in a continuous casting machine provided with an inclined straight moulding cavity to produce a continuous bar of copper, comprising guiding said bar as it leaves the casting device towards a horizontal rolling machine known "per se" along a curved path, the maximum curvature of the curved path being less than 0.25 $m^{-1}$ thus preventing the formation of cracks in the hot bar, and converting the said bar into wire rod in the said rolling machine.

5 Claims, 7 Drawing Figures

10

MANUFACTURE OF COPPER WIRE ROD

This invention relates to a new process for the manufacture of copper wire rod and to the new product obtained by such process.

Under the expression "wire rod" it is understood a hot rolled wire having a diameter comprised between 6 and 10 mm and used as the starting material in wire-drawing mills.

Specialists in that art know that the capacity of a wire rod to be wiredrawn is improved if the non-metallic inclusions of the wire rod, especially the oxides, are more finely divided and more uniformly distributed.

In a known process for the manufacture of copper wire rod the starting materials are individual bars of trapezoidal section called "wirebars". According to that known process, the wirebars are brought to their hot rolling temperature and are converted into wire rod by drawing. That process has the drawback of not using the heat contained in the liquid copper which is cast in the form of wirebars, for the subsequent hot conversion of the wirebars into wire rod. Another drawback of that process is the presence in the wire rod of particularly voluminous inclusions of copper oxide near its periphery, such inclusions being due to strong concentrations of oxide in the peripheric areas of the wirebar, said concentrations of oxide being themselves due to the discontinuous casting of the wirebars and to their subsequent heating before rolling. These drawbacks are well known by specialists in the art.

In another known process for the manufacture of copper wire rod use is made of a curved casting groove in a casting wheel to cast in a continuous manner a curved copper bar, the latter being afterwards straightened and guided towards a rolling mill where it is immediately rolled into wire rod. As the cast copper is very brittle when hot, owing to its coarse grained basaltic structure, the straightening of the curved bar before its introduction into the rolling mill and also the deformation of the straightened bar during the first rolling pass produce numerous cracks through which air enters into the copper to form immediately voluminous veins of oxide. Afterwards, the said oxidized cracks are closed again under the effect of the rolling, but the veins of oxide remain enclosed in the bar of copper during the rolling and are found again in the wire rod. Such oxides introduced into the copper after the casting process are called "exogeneous oxides" by the specialists in the art, in opposition to the oxides due to the oxygen introduced inside the copper before and during the casting process, and which are called "indogeneous oxides".

In order to avoid the above mentioned drawbacks of the process using a casting wheel, it has already been proposed to project liquid copper into a moulding cavity of a casting wheel, in the form of a violent jet so as to render the liquid mass in the moulding cavity strongly turbulent, thus producing a cast bar with a fine grained equiaxial structure with grains which are less brittle when the bar is hot, then basaltic copper; at the same time it was provided to surround the jet of liquid copper with an atmosphere of oxygen in order to avoid the formation of air bubbles inside the cast bar, which air bubbles may be caused by the violence of the liquid metal leaving the casting spout. Such a process complicates the casting process, and moreover it yields cast copper with a high content of oxide, which is not desirable. Such process moreover does not seem to have been applied industrially.

It has also been proposed to cast a continuous copper bar in a casting machine having a straight moulding cavity and to guide the cast bar in a straight line towards a wire rod drawing mill in a straight line along the common axis of the moulding cavity and the wire rod drawing mill. As the proposed casting device cannot work with its moulding cavity in a horizontal position, it is easy to understand the difficulties involved by the carrying out in practice of that process of the prior art, especially for the construction and mounting of the first rolling stands. Moreover, that method of the prior art mentioned last did not provide any means to prevent the formation of cracks in the copper bar during the first rolling pass.

The present invention allows of avoiding the drawbacks of the known processes.

According to the process of the present invention, liquid copper is cast in a continuous casting machine having an inclined straight moulding cavity for producing a continuous bar of copper, said bar is guided, as it leaves the casting machine, towards a horizontal rolling machine known "per se" along a curved path, the maximum curvature of the bar being less than 0.25 $m^{-1}$ in order to prevent the formation of cracks in the bar when hot, and the bar is converted into wire rod in the said rolling machine.

In the process according to the present invention, it is preferable to cast a bar the cross section of which is more than 70 times larger than the cross section of the wire rod to be produced in order to obtain a thorough working during the rolling mill.

According to another characteristic feature of the invention, use is made of a moulding cavity having a rectangular cross section the base of which is more than 1.5 times larger than its height; for obtaining the two large walls of the moulding cavity use is made of two parallel metallic bands, which are made to advance in a manner known "per se" in the same direction as the cast bar, and which are intensively cooled with water in order to obtain a rapid solidification of the cast copper, and the liquid copper is introduced into the moulding cavity at a temperature lower than 1130°C and with a sufficient flow to produce a cast bar at a speed higher than 8 meters/minute so as to obtain a substantially equiaxial casting structure with fine grains.

The copper wire rod obtained by the above process is characterized by a uniform distribution of the inclusions of indogeneous copper oxide and by the complete absence of veins of exogeneous copper oxide, and thanks to these features it is possible to wiredraw this wire rod into fine wire without previous shaving. Such wire rod is industrially produced by the Applicant Company and sold under the trade mark "Contirod".

The special features and advantages of the present invention are clearly brought out in the description, given hereinafter by way of example, with reference to the accompanying drawings, in which.

Figure 1:
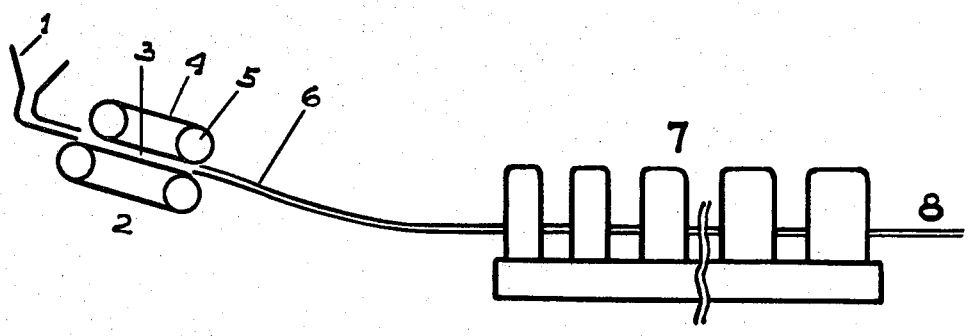
FIG. 1 is a diagrammatical view of an apparatus suitable for carrying out the process according to the invention, said apparatus comprising a machine for continuous casting, and a rolling mill.

According to one mode of carrying the process of the invention into effect, liquid copper is continuously introduced through a feeding device shown at 1 (FIG. 1) into a continuous casting machine 2 having a straight moulding cavity 3 formed by two endless metallic bands 4 rotating around drums 5, and by two side dams (not shown), which separate the said bands. That type of casting machine which has long been used for the continuous casting of metallic bands, is well known to specialists in the art.

In that example, the length of the moulding cavity 3 is 4.5 m and the cross section is 50 mm × 110 mm (distance between the bands x distance between the side dams).

The copper bar 6 leaving the casting device 2 is guided, when hot, via means for regulating the temperature, for trimming and/or for cleaning which are known "per se", and which have not been illustrated, towards the horizontal rolling mill 7 along a slightly curved path, the maximum curvature of which is 0.09 $m^{-1}$ (the maximum curvature of a curve being the inverse of the radius of the most curved part of the said curve).

In the rolling mill 7, which is of a conventional type with 14 stands, the cast bar 6 is converted at ± 800°C into wire rod 8 having a diameter of 8 mm.

Figure 2:
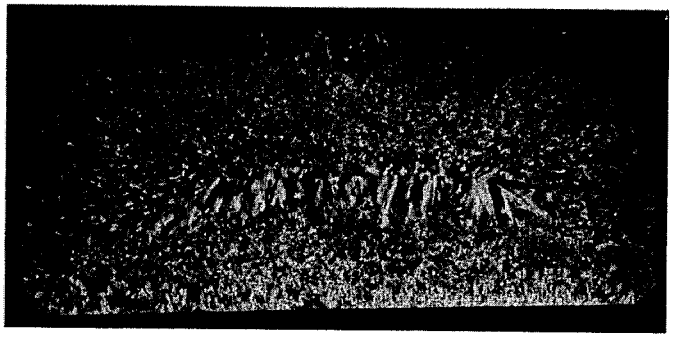
FIG. 2 shows a cross section of a copper bar leaving the casting machine shown in FIG. 1, and obtained by the process according to the invention.

Let us consider again the casting process. Liquid copper is introduced into the casting machine 2 at a temperature of about 1120°C and at a rate of about 32 tons/hour, thus producing, at a speed of about 12 meters/minute, a cast bar a cross section of which is represented in FIG. 2, showing the substantially equiaxial fine grained structure of the bar thus cast, the said structure being typical of cast metal rapidly solidified to the core. This rapid solidification to the core of the liquid copper was made possible by acting solely upon the temperature and the casting speed, thanks to the use of a mould the wall of which is formed for its major part of thin bands ensuring a rapid removal of the heat. This was not possible with the casting wheel used in the process of the prior art, in which the wall of the mold is formed for its major part of the groove of the wheel.

Figure 3:
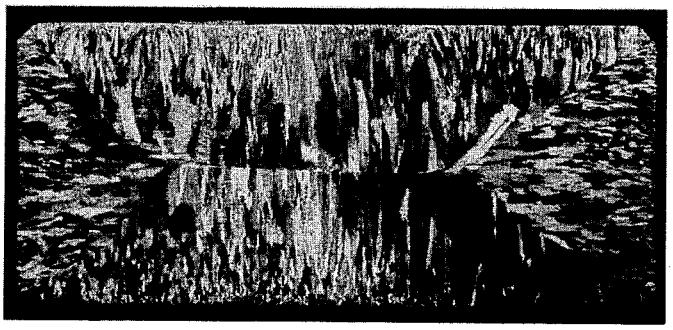
FIG. 3 shows a cross section of a copper bar leaving the casting machine according to FIG. 1 and obtained according to a non-preferential mode of carrying the invention into effect.

By way of comparison, FIG. 3 represents a basaltic structure (the drawbacks of which have been mentioned above) of a copper bar produced in the same casting machine 2, starting from liquid copper the temperature of which was about 1140°C.

As shown in FIGS. 4 to 7, the process according to the present invention produces a copper wire rod which differs from the wire rod obtained by the known process employing a casting wheel, by a more uniform distribution of the inclusions of indogeneous oxides and by the complete absence of veins of exogeneous oxides.

FIGS. 4 to 7 are microphotographs of samples taken from wire rod obtained by the process according to the present invention and from wire rod obtained by the known process using a casting wheel; in both cases, the liquid copper used as starting material was of similar chemical composition. Before being microphotographed, the samples had been polished with emery paper, then with a diamond paste, and finally with magnesia.

Figure 4:
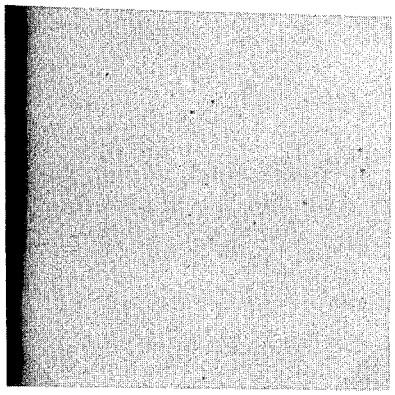
FIG. 4 is a microphotograph of part of a cross section of a wire rod manufactured according to the process of the invention, said part being adjacent to the periphery of the rod.

FIG. 4 is a microphotograph obtained with a magnification 500 times higher, of part of a cross section of the wire rod 8 according to FIG. 1, said part being adjacent to the periphery of the rod.

Figure 5:
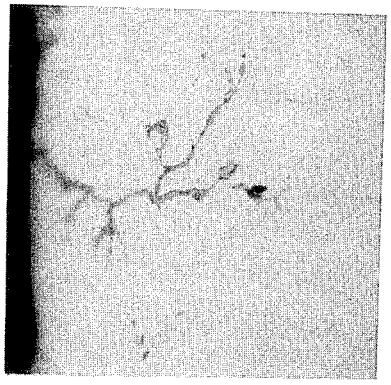
FIG. 5 is a microphotograph of part of a cross section of a wire rod manufactured by a known process using a casting wheel, said part being adjacent to the periphery of the rod.

FIG. 5 is a microphotograph made in the same way as that of FIG. 4 of a peripheric part of a cross section of a wire rod obtained by the known process using a casting wheel. FIG. 5 shows at 10 a vein of exogeneous copper oxide. The cross section of the wire rod of which FIG. 5 represents a part, showed 14 of these veins. It has been possible to count 80 veins the length of which could attain 80 microns, in a set of 7 cross sections made in said wire rod at regular intervals, whilst a similar examination of wire rod 8 did not show any veins of exogeneous oxide. Owing to the presence of these veins of oxide in the wire rod obtained via a casting wheel, said wire rod is liable to break more readily in the course of the wiredrawing than the wire rod 8 according to the present invention, unless it had been previously shaved.

Figure 6:
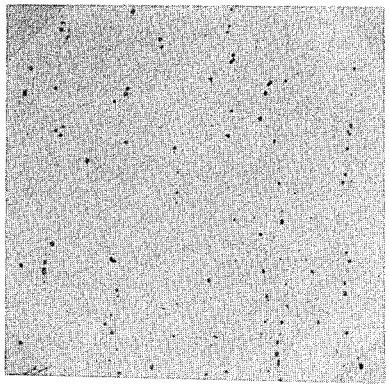
FIG. 6 is a microphotograph of part of a longitudinal section of the same wire rod as in FIG. 4, said part being adjacent to the centre of the rod.
Figure 7:
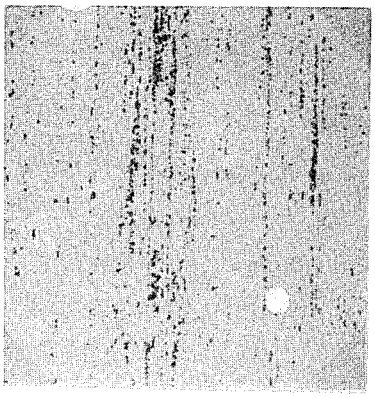
FIG. 7 is a microphotograph of part of a longitudinal section of the same wire rod as in FIG. 5, said part being adjacent to the centre of the rod.

FIG. 6 is a microphotograph obtained with a magnification of 200 times, of a part of longitudinal section of wire rod 8 of FIG. 1, said part being adjacent to the centre of the rod. FIG. 7 is a microphotograph effected in the same way of that of FIG. 6, of a central part of a longitudinal section of the wire rod of FIG. 5. In FIG. 6, and 7 the black spots represent inclusions of indogeneous oxides. On comparing FIG. 6 and 7, it appears that the inclusions of oxides are more uniformly distributed in the rod 8 of the invention, than in the rod obtained via a casting wheel. That difference is due to the more thorough working of the wire rod 8, which was obtained by rolling a cast bar 6 (FIG. 1) having a cross section of 5500 $mm^2$, whereas the cross section of the bar obtained with the casting wheel was only of 2800 $mm^2$. Moreover, the cast bar 6 had a casting structure (substantially equiaxial with fine grains), that is showing a better distribution of oxide than that of the cast bar (a basaltic with coarse grains) used in the manufacture of the wire rod with the casting wheel. In view of the difference between the wire rod 8 and that obtained via a casting wheel with respect to the distribution of indogeneous oxide inclusions, the wire rod obtained with a casting wheel will break more readily in the course of wiredrawings than the wire rod 8.

What we claim is:

1. A process for the manufacture of copper wire rod, in which liquid copper is cast in a continuous casting machine provided with an inclined straight moulding cavity to produce a continuous bar of copper, comprising guiding said bar as it leaves the casting machine towards a horizontal rolling machine along a curved path, the maximum curvature of the curved path being less than 0.25 $m^{-1}$ and the cross-section of the bar being more than 70 times larger than the cross-section of the wire rod to be produced.

2. A process as set forth in claim 1 in which the moulding cavity has a rectangular cross section.

3. A process as set forth in claim 1 in which the base of the rectangle is more than 1.5 times larger than the height of the rectangle.

4. A process as set forth in claim 2 in which the two wide walls of the moulding cavity are composed of two parallel metallic bands which are caused to advance in the same direction as the cast bar, and which are intensively cooled with water in order to obtain a rapid solification of the cast copper.

5. A process as in claim 1, in which liquid copper is introduced into a casting machine having a moulding cavity of rectangular shape, the base of the rectangle being more than 1.5 times larger than height of the rectangle, at a temperature lower than 1130°C. but still sufficient to leave the copper in the liquid state before entering the casting machine, and with a sufficient flow to produce a cast bar at a speed higher than 8 meters/-minute, the two wide walls of the moulding cavity being composed of two parallel metallic bands which are caused to advance in the same direction as the cast bar, and intensively cooling the said bands while advancing, thus obtaining a casting structure substantially equiaxial with fine grains.

* * * * *